US010244328B2

(12) United States Patent
Yuen et al.

(10) Patent No.: US 10,244,328 B2
(45) Date of Patent: Mar. 26, 2019

(54) MOVING-COIL SPEAKER

(71) Applicant: Innovation Sound Technology Co., Ltd., Shenzhen, Guangdong (CN)

(72) Inventors: Shun Ming Yuen, Guangdong (CN); Lei Zheng, Guangdong (CN); Chun Lan, Guangdong (CN)

(73) Assignee: Innovation Sound Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/079,095

(22) PCT Filed: Apr. 6, 2016

(86) PCT No.: PCT/CN2016/078536
§ 371 (c)(1),
(2) Date: Aug. 23, 2018

(87) PCT Pub. No.: WO2017/173600
PCT Pub. Date: Oct. 12, 2017

(65) Prior Publication Data

US 2019/0052973 A1 Feb. 14, 2019

(51) Int. Cl.
*H04R 9/06* (2006.01)
*H04R 3/00* (2006.01)
(Continued)

(52) U.S. Cl.
CPC ..... *H04R 9/06* (2013.01); *H04R 3/00* (2013.01); *H04R 7/127* (2013.01); *H04R 7/18* (2013.01);
(Continued)

(58) Field of Classification Search
CPC . H04R 9/00; H04R 9/06; H04R 9/025; H04R 19/02; H04R 19/013;
(Continued)

(56) References Cited

U.S. PATENT DOCUMENTS

2009/0285417 A1* 11/2009 Shin ..... H04M 1/03 381/151
2016/0182992 A1* 6/2016 Munro ..... H04R 1/2811 381/380
2017/0353780 A1* 12/2017 Huang ..... H04R 1/10

FOREIGN PATENT DOCUMENTS

WO WO-2015103731 A1 * 7/2015 ..... H04R 7/125

* cited by examiner

*Primary Examiner* — Thang V Tran

(57) ABSTRACT

A moving-coil speaker includes: a magnetic path unit (1); an annular frame (3) connected to exterior of the magnetic path unit (1) and used to carry a membrane (2); and a PCB (4) installed on the frame (3) and used to solder thereon a component or provide electrical conduction. An outer perimeter of the frame (3) is 45 mm. A positioning pin (5) is disposed at a front side of the frame (3) and overlapping with a central axle extension line of the PCB (4). Two sets of air vents (6) are provided on the frame on two sides of the positioning pin (5). A tune paper (7) is pasted on the surface of the frame (3) on the two sides of the positioning pin (5). A distance between the positioning pin (5) and the center of a first air vent at the starting place of each set of air vents (6) is equivalent to a distance between a side of the PCB (4) and the center of a second air vent at the last place of each set of air vents (6). The Φ45 mm speaker is a balance between a Φ40 mm speaker and a Φ50 mm speaker, and can meet requirements with respect to structures and appearances for this type of earphones.

14 Claims, 4 Drawing Sheets

(51) Int. Cl.
*H04R 1/02* (2006.01)
*H04R 7/12* (2006.01)
*H04R 7/18* (2006.01)

(52) U.S. Cl.
CPC .. *H04R 2307/025* (2013.01); *H04R 2307/027* (2013.01)

(58) Field of Classification Search
CPC ..... H04R 2307/025; H04R 2307/027; H04R 7/00; H04R 7/18; H04R 7/127; H04R 1/00; H04R 1/02; H04R 1/025; H04R 1/28; H04R 1/1008; H04R 1/1016; H04R 1/2823; H04R 1/2826; H04R 3/00; H04R 11/02; H04R 2460/13; G06F 1/1605; G10K 9/122
See application file for complete search history.

MOVING-COIL SPEAKER

TECHNICAL FIELD

The disclosure relates to a moving-coil speaker, and particularly to a small size speaker having a diameter of 45 mm.

BACKGROUND

A moving-coil earphone is a most ordinary and common earphone. A driving unit of the moving-coil earphone is substantially a small size moving-coil speaker in which a voice coil in a permanent magnetic field drives a vibration membrane (or diaphragm) connected to the voice coil to vibrate. The moving-coil earphone has a high efficiency, can output driving power to an earphone of audio equipment, and is reliable and durable.

A headphone in current market uses a micro-speaker having a diameter of 30 mm, 40 mm, 50 mm, 57 mm, 60 mm and etc. However, for a supra-aural earphone, a speaker having a diameter of 40 mm is too small in size, has a relatively small radiation area, and has an insufficient radiated sound pressure when volume up is pressed. But a speaker having a diameter of 50 mm is relatively big, thus makes the whole set bulky.

SUMMARY

The disclosure is intended to provide a moving-coil speaker having a diameter of 45 mm and an improved frequency-response curve.

To this end, embodiments of the disclose provide a moving-coil speaker, including a magnetic circuit unit and a toroidal support, connected to an exterior of the magnetic circuit unit, arranged to carry a diaphragm, the support being provided with a Printed Circuit Board (PCB) for soldering a wire thereon and performing current conduction, wherein the support has an outer diameter of 45 mm and has a positioning bone, arranged on a front surface of the support, which coincides with an extending line of a middle axis of the PCB, two groups of air holes are provided symmetrically on the support on both sides of the positioning bone, a tuning paper is attached on a surface of the support on each side of the positioning bone, and a distance between a first air hole of each group of air holes and the positioning bone is equal to a distance between a second air hole of said each group of air holes and a side edge of the PCB, the first air hole and the second air hole being located in a first place and a last place among said each group of air holes.

In an embodiment, each of the first and second air holes is in the shape of a circle, and a connection line from a center of the first air hole to a center of the support forms an included angle of 20 degree with an extending line of the positioning bone; and a connection line from a center of the second air hole to the center of the support forms an included angle of 20 degree with an extending line of the side edge of the PCB.

In an embodiment, the diaphragm comprises a dome portion and an outer arc portion connected with an outer edge of the dome portion, there being at least 55 ribs disposed with uniform intervals on a surface of the outer arc portion.

In an embodiment, the diaphragm comprises a metallic coating layer coated at least on a surface of the dome portion.

In an embodiment, the diaphragm is made of a PAR material layer, a PU material layer and a PEEK material layer having a same shape.

In an embodiment, the diaphragm is made of PET material.

In an embodiment, the diaphragm is made of PEN material.

In an embodiment, the diaphragm is made of PEI material.

In an embodiment, the diaphragm is made of PEEK material.

Embodiments of the disclosure have the following beneficial effects.

To make a compromise between a speaker having a diameter of 40 mm and a speaker having a diameter of 50 mm, there is provided a speaker having an outer diameter of 45 mm so as to meet requirements of such earphones on structure and appearance.

As shown in FIG. 2, a tuning paper of a conventional speaker support is a whole tuning paper, thus for an adhesive-backed tuning paper, it tends to be deflectively attached, and it is difficult to adjust a deflectively attached adhesive-backed tuning paper, thereby resulting in a high scrap rate. Based on a conventional support, embodiments of the disclosure add a positioning bone, and make air holes offset slightly into two symmetrical portions. Furthermore, four side holes have a same angle with respect to positioning studs on both sides. Thus, thus tuning papers on the left and right sides of the support can use a same tuning paper, thereby facilitating sticking of an adhesive-backed tuning paper and reducing scrap rate of the tuning paper. In the structure design of the new support, air holes adjacent on two sides of the PCB have relatively close distances, and the overall distribution of all air holes is relatively dispersive. Thus, balanced air permeability is resulted, and it is possible to achieve the objective of improving the frequency-response curve and frequency-response characteristics through optimization of size and structure taking into consideration of vibration equilibrium.

BRIEF DESCRIPTION OF THE DRAWINGS

The moving-coil speaker according to embodiments of the disclosure is elaborated below with reference to drawings.

DETAILED DESCRIPTION

Embodiments

Figure 1:
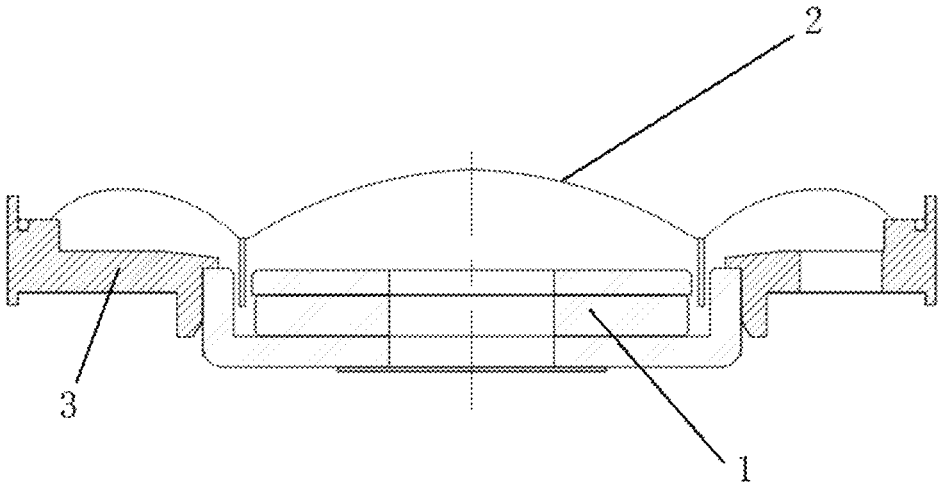
FIG. 1 is a schematic structural diagram of a moving-coil speaker according to an embodiment of the disclosure.
Figure 2:
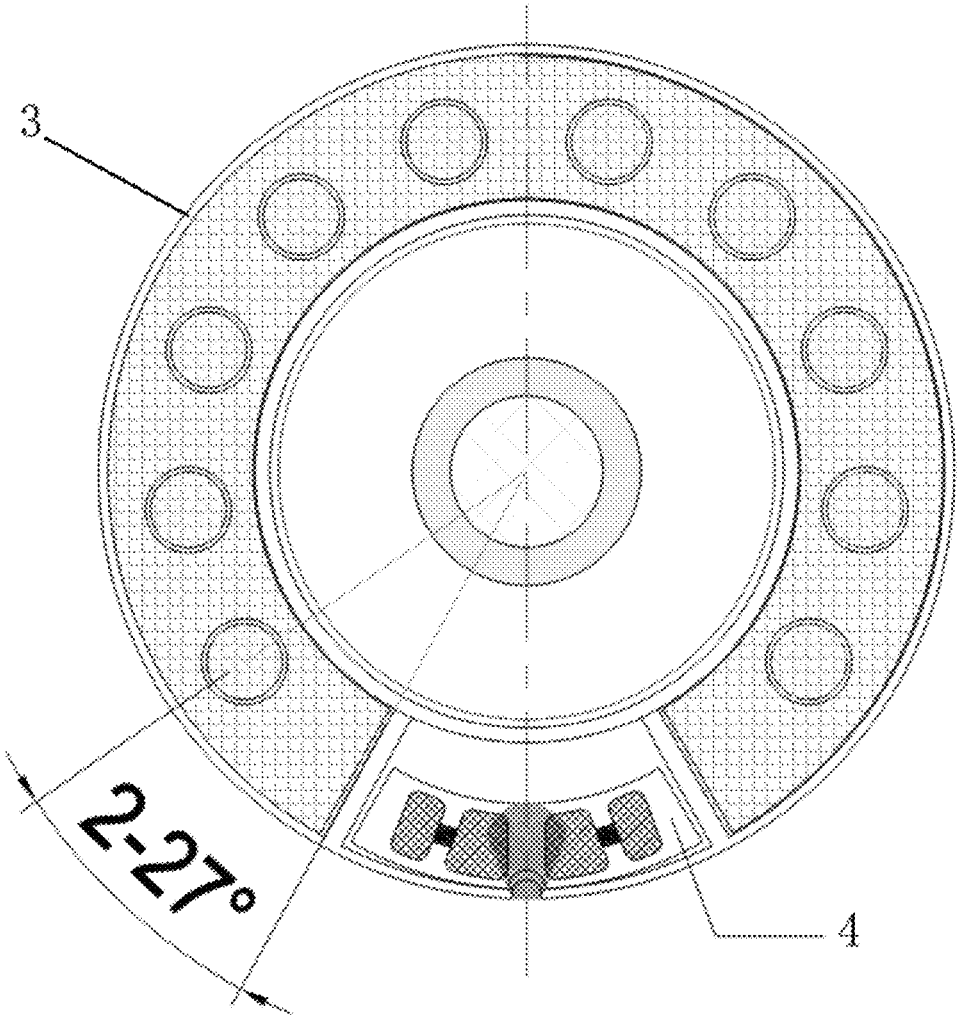
FIG. 2 is a schematic structural diagram of a conventional support.

As shown in FIG. 1, a moving-coil speaker according to an embodiment of the disclosure includes: a magnetic circuit unit 1, and a toroidal support 3, connected to an exterior of the magnetic circuit unit 1, for carrying a diaphragm 2.

The support 3 is provided with a Printed Circuit Board (PCB) 4 for soldering a wire thereon and performing current conduction, and the support 3 has an outer diameter of 45 mm.

Figure 3:
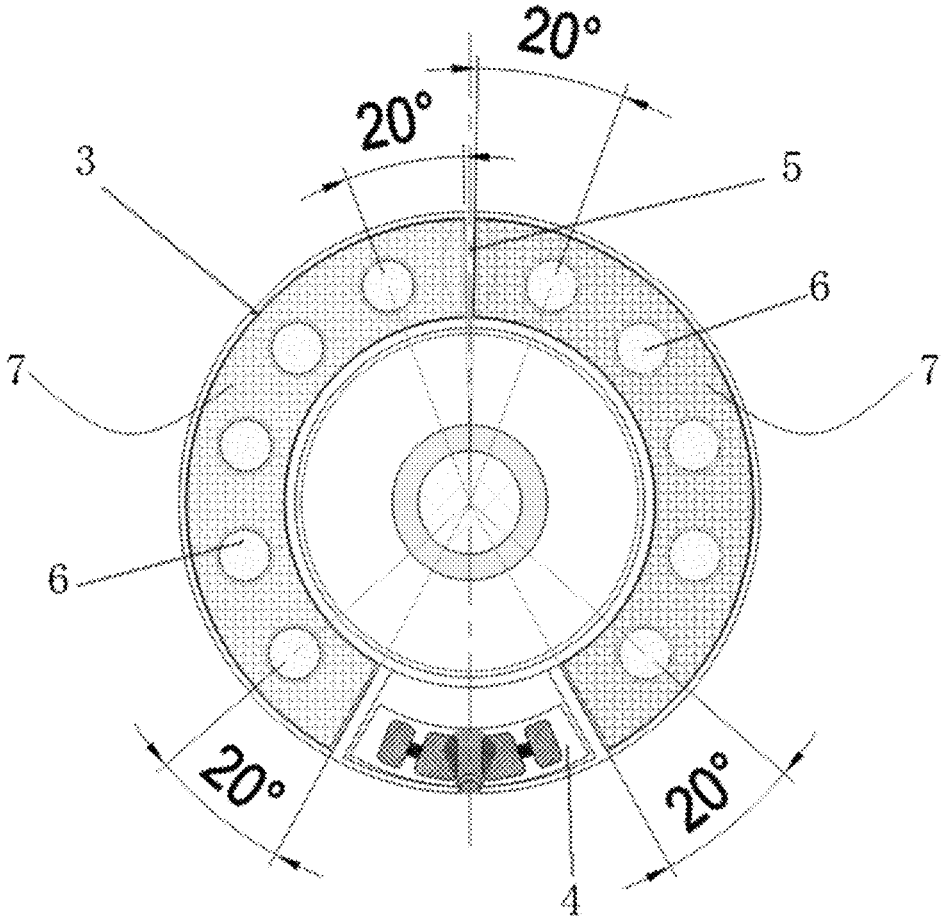
FIG. 3 is a schematic structural diagram of a support according to an embodiment of the disclosure.

As shown in FIG. 3, the support 3 has a positioning bone 5, arranged on a front surface of the support 3, which coincides with an extending line of a middle axis of the PCB 4, two groups of air holes 6 are provided symmetrically on the support 3 on both sides of the positioning bone 5, a tuning paper 7 is attached on a surface of the support 3 on each side of the positioning bone 5, and a distance between a first air hole of each group of air holes 6 and the positioning bone 5 is equal to a distance between a second air hole of said each group of air holes 6 and a side edge of the PCB 4, herein the first air hole and the second air hole is located in a first place and a last place among said each group of air holes 6.

Each of the first and second air holes is in the shape of a circle, and a connection line from a center of the first air hole to a center of the support 3 forms an included angle of 20 degree with an extending line of the positioning bone 5; and a connection line from a center of the second air hole to the center of the support 3 forms an included angle of 20 degree with an extending line of the side edge of the PCB 4. Certainly, the air holes may also have other shapes, such as rectangle, hexagon or the like.

Figure 4:
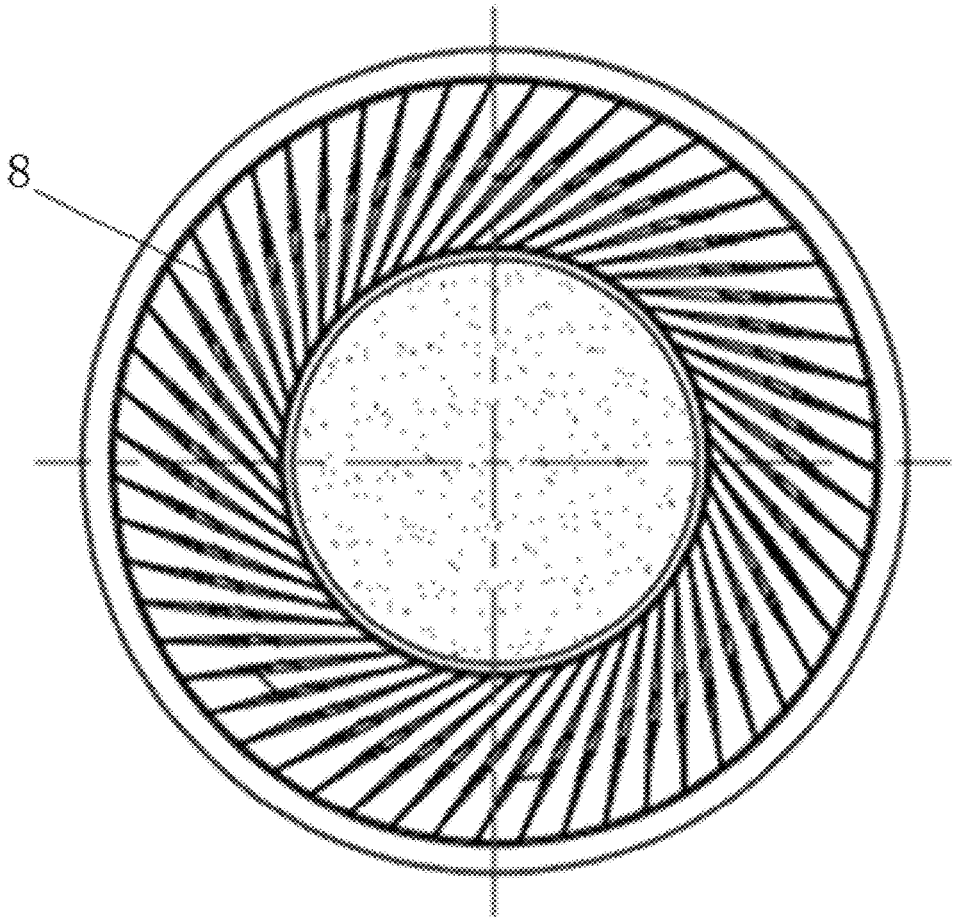
FIG. 4 is a schematic diagram of a diaphragm having a metallic coating layer sprayed on a surface of the diaphragm according to an embodiment of the disclosure.

As shown in FIG. 4, the diaphragm 2 includes a dome portion and an outer arc portion connected with an outer edge of the dome portion, and there are at least 55 ribs 8 disposed with uniform intervals on a surface of the outer arc portion. The diaphragm 2 has a metallic coating layer coated on a surface of the dome portion and on a partial surface of the outer arc portion. For tuning voice, position and area of the metallic coating layer may change arbitrarily.

In an embodiment, the diaphragm 2 is made of a PAR material layer, a PU material layer and a PEEK material layer having a same shape.

In an embodiment, the diaphragm 2 is made of PET material.

In an embodiment, the diaphragm 2 is made of PEN material.

In an embodiment, the diaphragm 2 is made of PEI material.

In an embodiment, the diaphragm 2 is made of PEEK material.

The disclosure is not limited to the above embodiments. Technical solutions according to above embodiments can be combined to obtain new technical solutions. In addition, all equivalents of the technical solutions of the disclosure fall within the scope of the claims.

The invention claimed is:

1. A moving-coil speaker, comprising a magnetic circuit unit and a toroidal support, connected to an exterior of the magnetic circuit unit, arranged to carry a diaphragm, the support being provided with a Printed Circuit Board (PCB) for soldering a wire thereon and performing current conduction, wherein the support has an outer diameter of 45 mm and has a positioning bone, arranged on a front surface of the support, which coincides with an extending line of a middle axis of the PCB, two groups of air holes are provided symmetrically on the support on both sides of the positioning bone, a tuning paper is attached on a surface of the support on each side of the positioning bone, and a distance between a first air hole of each group of air holes and the positioning bone is equal to a distance between a second air hole of said each group of air holes and a side edge of the PCB, the first air hole and the second air hole being located in a first place and a last place among said each group of air holes.

2. The moving-coil speaker according to claim 1, wherein each of the first and second air holes is in the shape of a circle, and a connection line from a center of the first air hole to a center of the support forms an included angle of 20 degree with an extending line of the positioning bone.

3. The moving-coil speaker according to claim 1, wherein the diaphragm comprises a dome portion and an outer arc portion connected with an outer edge of the dome portion, there being at least 55 ribs disposed with uniform intervals on a surface of the outer arc portion.

4. The moving-coil speaker according to claim 3, wherein the diaphragm comprises a metallic coating layer coated at least on a surface of the dome portion.

5. The moving-coil speaker according to claim 1, wherein the diaphragm is made of a PAR material layer, a PU material layer and a PEEK material layer having a same shape.

6. The moving-coil speaker according to claim 1, wherein the diaphragm is made of PET material.

7. The moving-coil speaker according to claim 1, wherein the diaphragm is made of PEN material.

8. The moving-coil speaker according to claim 1, wherein the diaphragm is made of PEI material.

9. The moving-coil speaker according to claim 1, wherein the diaphragm is made of PEEK material.

10. The moving-coil speaker according to claim 2, wherein the diaphragm is made of a PAR material layer, a PU material layer and a PEEK material layer having a same shape.

11. The moving-coil speaker according to claim 2, wherein the diaphragm is made of PET material.

12. The moving-coil speaker according to claim 2, wherein the diaphragm is made of PEN material.

13. The moving-coil speaker according to claim 2, wherein the diaphragm is made of PEI material.

14. The moving-coil speaker according to claim 2, wherein the diaphragm is made of PEEK material.

* * * * *